US007568678B2

(12) United States Patent
Hammond

(10) Patent No.: US 7,568,678 B2
(45) Date of Patent: Aug. 4, 2009

(54) APPARATUS FOR REMOVING AND REINSTALLING THE HARDTOP OF AN AUTOMOBILE

(76) Inventor: Larry Hammond, 4643 Granada Ave., Riverside, CA (US) 92504

( * ) Notice: Subject to any disclaimer, the term of this patent is extended or adjusted under 35 U.S.C. 154(b) by 0 days.

(21) Appl. No.: 11/726,071

(22) Filed: Mar. 20, 2007

(65) Prior Publication Data

US 2009/0035115 A1 Feb. 5, 2009

(51) Int. Cl.
*B66D 1/36* (2006.01)

(52) U.S. Cl. ..... 254/338; 248/327; 414/626

(58) Field of Classification Search ..... 254/334, 254/338; 248/327, 323; 150/166, 168; 383/22, 383/97, 67; 296/136; 160/370.2; 414/626
See application file for complete search history.

(56) References Cited

U.S. PATENT DOCUMENTS 4,381,055 A 4/1983 Picaud
4,576,542 A 3/1986 Brasell et al.
4,600,177 A 7/1986 Fritz
5,263,687 A 11/1993 Garbiso
5,897,104 A 4/1999 Garbiso
5,984,275 A 11/1999 Hoslett
6,056,274 A * 5/2000 Naas et al. ..... 254/335
6,152,427 A 11/2000 Hoslett
6,283,531 B1 * 9/2001 Tanigawa et al. ..... 296/103
6,386,515 B1 * 5/2002 Sachtleben ..... 254/338
6,685,170 B1 * 2/2004 Gwynn ..... 254/325
6,786,494 B2 * 9/2004 Garbiso ..... 280/38
6,959,918 B1 11/2005 Samuels
7,150,449 B1 * 12/2006 Dueck et al. ..... 254/278

* cited by examiner

*Primary Examiner*—Emmanuel M Marcelo
(74) *Attorney, Agent, or Firm*—Edwin Tarver; Lauson & Tarver LLP

(57) ABSTRACT

An apparatus for removing and reinstalling the detachable hardtop of an automobile; the hardtop comprising a pair of opposite side panels, each panel comprising a downwardly extending pin at its bottom. The apparatus comprises a bracket for engaging the pins, an overhead winch for elevating and lowering the hardtop about the bracket, and adjustable straps for balancing the hardtop such that the hardtop is maintained in the same horizontal position as on the automobile when elevated and/or lowered.

20 Claims, 8 Drawing Sheets

APPARATUS FOR REMOVING AND REINSTALLING THE HARDTOP OF AN AUTOMOBILE

CROSS-REFERENCE TO RELATED APPLICATION

None

FEDERALLY SPONSORED RESEARCH

Not Applicable

SEQUENCE LISTING OR PROGRAM

Not Applicable

STATEMENT REGARDING COPYRIGHTED MATERIAL

Portions of the disclosure of this patent document contain material that is subject to copyright protection. The copyright owner has no objection to the facsimile reproduction by anyone of the patent document or the patent disclosure as it appears in the Patent and Trademark Office file or records, but otherwise reserves all copyright rights whatsoever.

BACKGROUND

The present invention relates in general to detachable automobile hardtops and more particularly to an apparatus for removing and reinstalling the hardtop of an automobile.

Removing an automobile hardtop manually is a strenuous task which easily requires at least two to three people to handle it efficiently. This task is generally difficult, time-consuming, and also involves a considerable risk of damaging the hardtop or the automobile body while handling. Several apparatuses are known in the art which are exclusively meant for handling the automobile hardtops.

For example, U.S. Pat. No. 5,897,104 to Garbiso discloses an overhead hoist and sling apparatus for removing, storing, and replacing a removable automobile hardtop. The apparatus comprises an overhead hoist supporting a sling comprised of sling members. The sling members extend around and under opposite extremities of the hardtop and across the underside of the hardtop such that the sling members support the hardtop with a cradling action when the hoist is operated to lift the sling to an elevated storage position. Certain of the sling members are spaced by a stabilizing member so as to maintain the cradled hardtop in a balanced position.

U.S. Pat. No. 4,576,542 to Brasell discloses a device for lifting removable automobile tops. The device comprises a longitudinal member connected to a hoist, upper and lower crossbars laterally extending from the longitudinal member. The upper and lower crossbars are arranged such that they envelope the vehicle top. Protective pads are provided on each end of the lower crossbar so that the underside of the top abuts the pads. Also, a protective pad is provided at the front of the longitudinal member such that the pad abuts the topside of the vehicle top. The device enables the vehicle top to be supported in a balanced horizontal position upon the application of a lifting force to the longitudinal member.

In U.S. Pat. No. 4,600,177, Fritz discloses a method of hoisting an automobile hardtop. The method incorporates a hoist for lifting a web strap having end hooks for attachment to the side ends of the hardtop. The method further makes use of a cable having end hooks for balancing hardtop such that the rear portion of the hardtop is elevated first.

The present invention is simpler as compared to the above disclosed art. Particularly when compared to the Fritz method of hoisting an automobile hardtop, the present invention eliminates the risk of damage by providing a means for engaging the side pins of the hardtop as opposed to hooks which engage the sides of the hardtop. The objects of the present invention will become better understood with reference to the appended Summary, Description, and Claims.

SUMMARY

The present invention is an apparatus for removing and reinstalling the hardtop of an automobile; the hardtop comprising a pair of side panels, each comprising a downwardly extending pin at its bottom. The present invention further comprises a sling and an overhead winch for elevating and lowering the hardtop about the sling.

The sling is defined by a 'U'-shaped bracket having two free ends, each comprising a bore for receiving the pins. The sling further comprises a pair of straps for engaging the front and rear extremities of the hardtop such that the hardtop is maintained in the same horizontal position as on the automobile previously.

FIGURES—REFERENCE NUMERALS

10 . . . Hardtop
12 . . . Top Panel
14 . . . Side Panel
16 . . . Port Hole
18 . . . Downwardly Extending Pin
20 . . . Sling
22 . . . Overhead Winch
24 . . . 'U'-shaped Bracket
26 . . . Arm
28 . . . Intermediate Member
30 . . . Rectangular Base
32 . . . Finger
34 . . . Vertical Bore
36 . . . Eyebolt
38 . . . Adjustable Strap
40 . . . Detachable Engaging Hook
42 . . . Wheel

DETAILED DESCRIPTION

Figure 1:
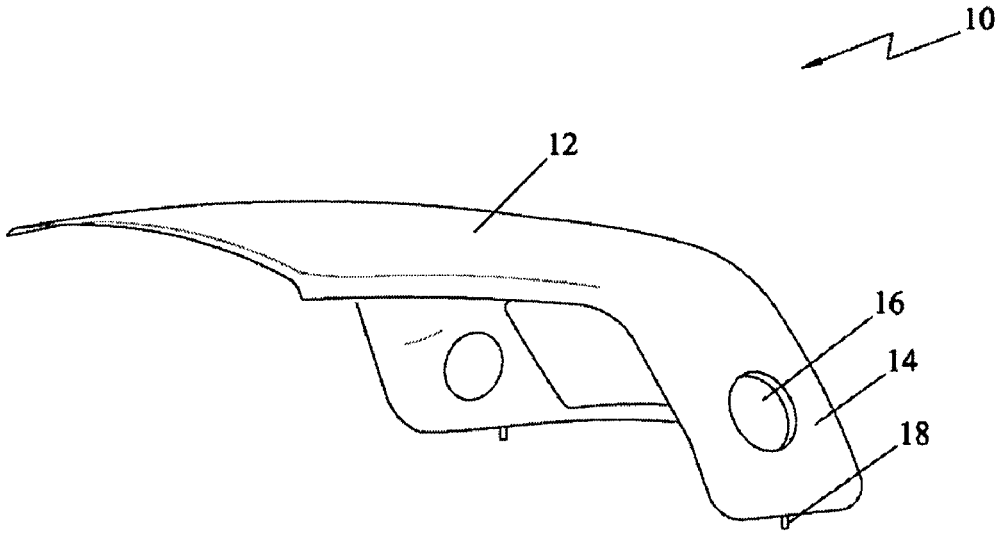
FIG. 1 is a perspective view of the hardtop of an automobile.

Referring to the drawings, a preferred embodiment of an apparatus for removing and reinstalling the hardtop of an automobile is illustrated in FIGS. 1 through 8. Referring to FIG. 1, the hardtop 10 generally comprises a top panel 12, a pair of side panels 14, each extending downward from the extremities of the top panel 12, and a rear panel, also extending downward from the rear end of the top panel 12. Each side panel 14 comprises a porthole 16, and a downwardly extending pin 18 at its bottom. The pins 18 are generally used for clamping the hardtop 10 over the automobile body. The apparatus of the present invention cannot be used for handling those hardtops which doesn't employ pins as a means for securing the hardtop over the automobile body.

Figure 2:
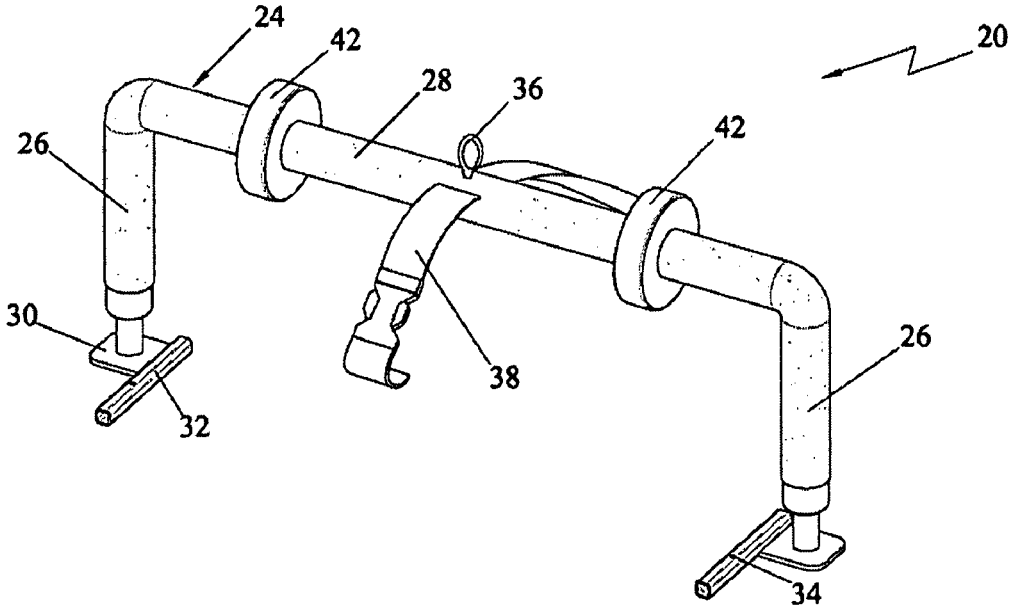
FIG. 2 is a perspective view of the sling in accordance with the present invention.
Figure 3:
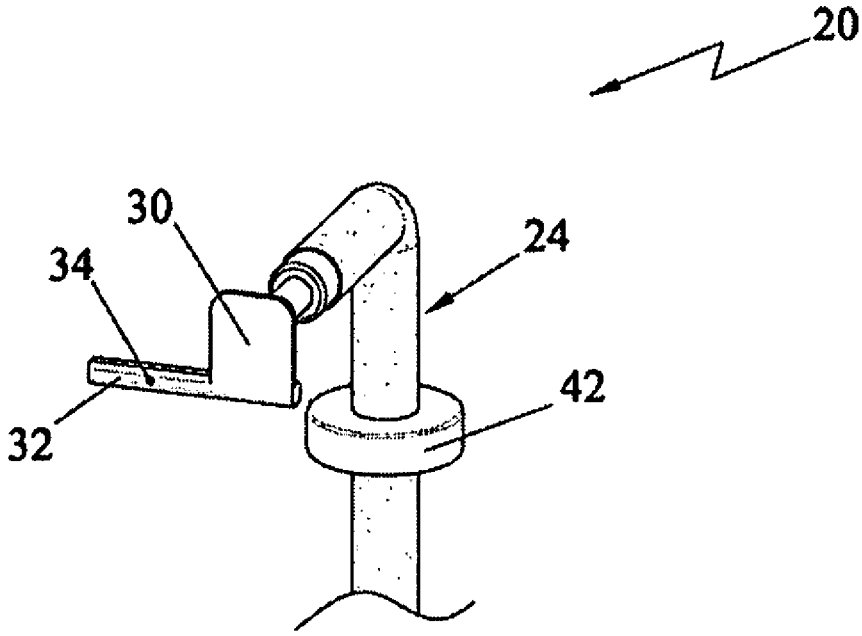
FIG. 3 is a perspective view of the free end of an arm in accordance with the present invention.

Referring to FIGS. 2 and 3, the apparatus comprises a sling 20 and an overhead winch 22 for elevating and lowering the sling 20. The sling 20 is defined by a 'U'-shaped bracket 24, which comprises a pair of arms 26 extending in a same direction from the extremities of an intermediate member 28 such that each arm 26 is substantially perpendicular to the intermediate member 28. The arms 26 and the intermediate member 28 are of same uniform circular cross-section. The free end of each arm 26 is fitted with a rectangular base 30 centrally. The inside edge of the rectangular base is abutted to a finger 32, which is of a rectangular cross-section; the inside edge of the base 30 and finger 32 being parallel. Each finger 32 comprises a vertical bore 34 as shown in FIG. 3. Further, the intermediate member 28 is fitted with an eyebolt 36 centrally such that it extends in a direction opposite to that of the pair of arms 26. The bracket 24 is suspended about the eyebolt 36 by the overhead winch 22.

Figure 4:
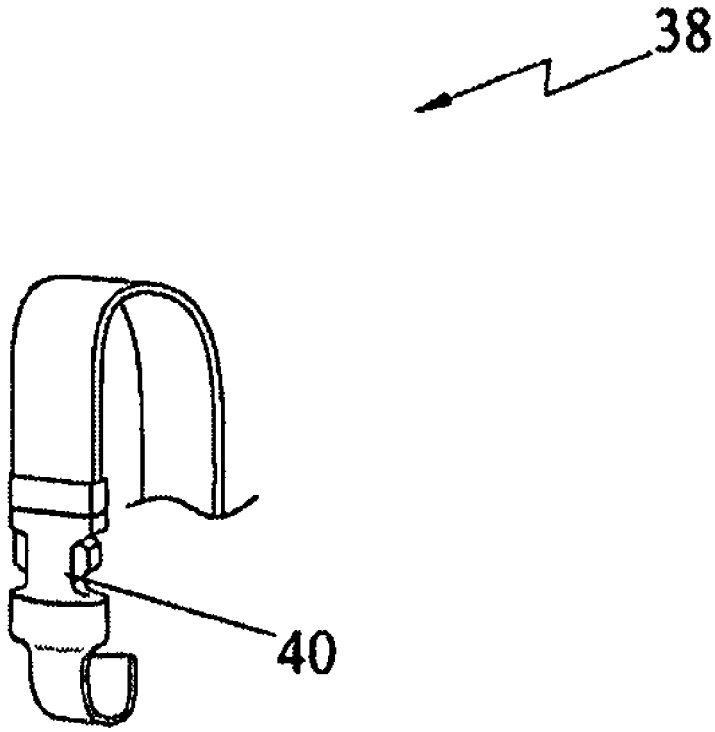
FIG. 4 is a perspective view of the engaging hook connected to the adjustable strap in accordance with the present invention.
Figure 5:
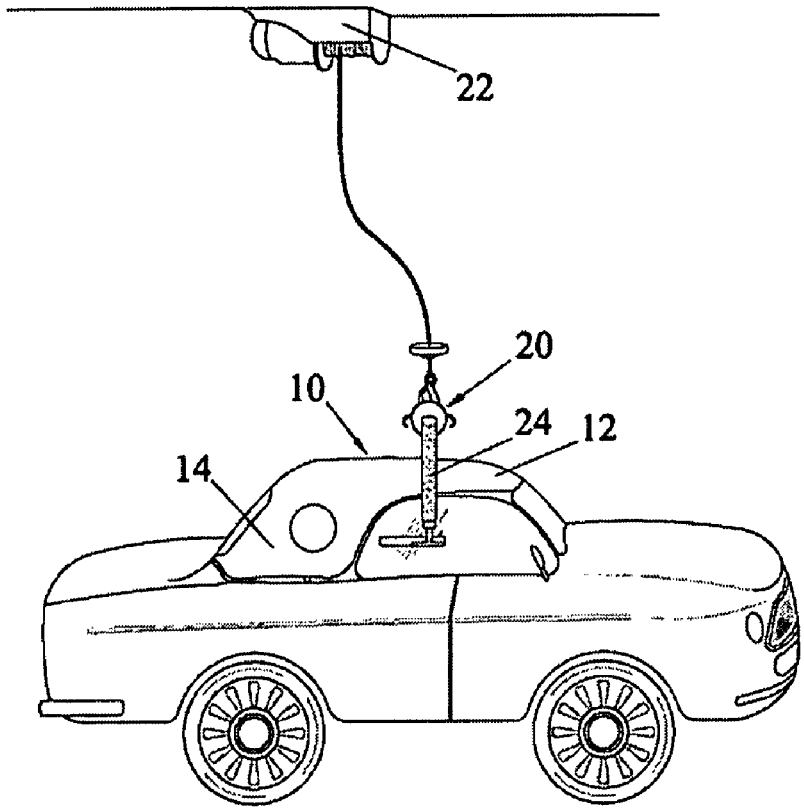
FIGS. 5 through 8 depict the sequential steps involved in using the apparatus in accordance with the present invention.
Figure 6:
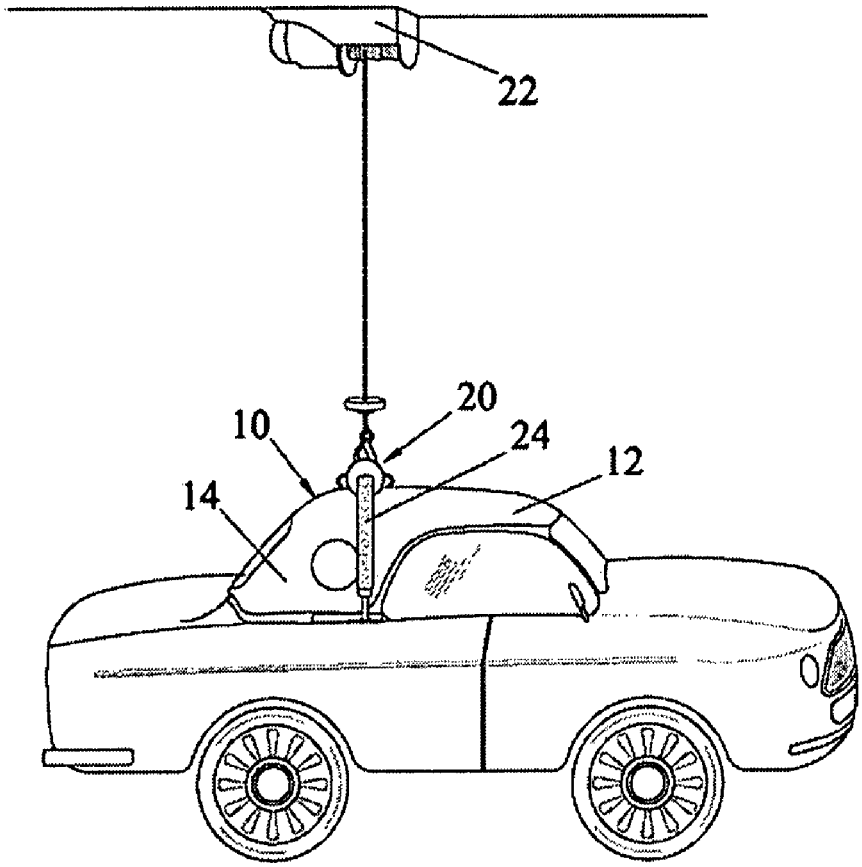
Figure 7:
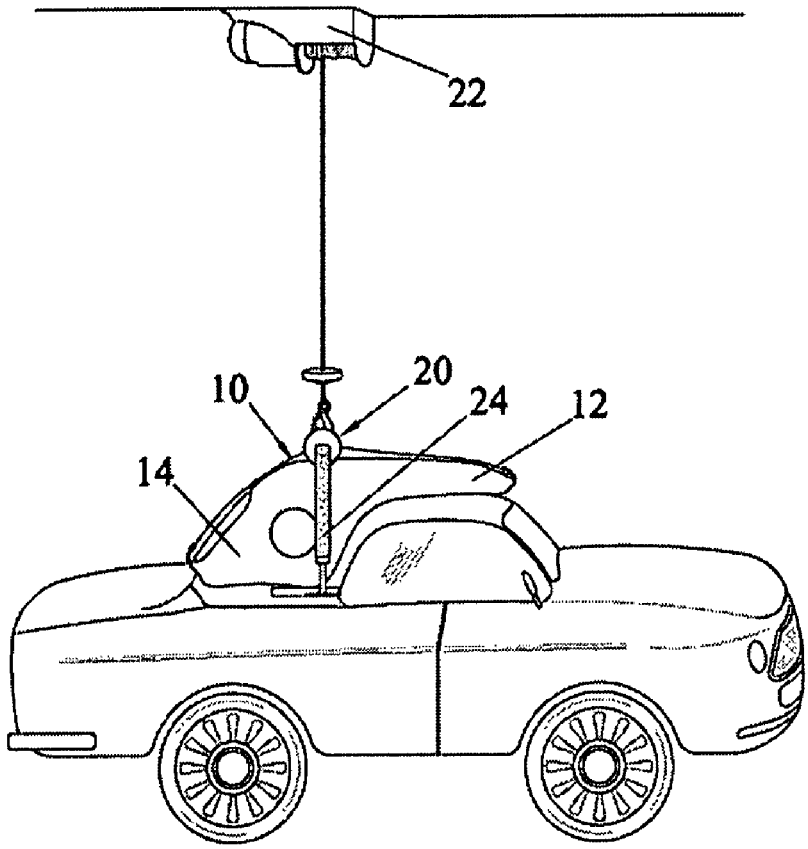
Figure 8:
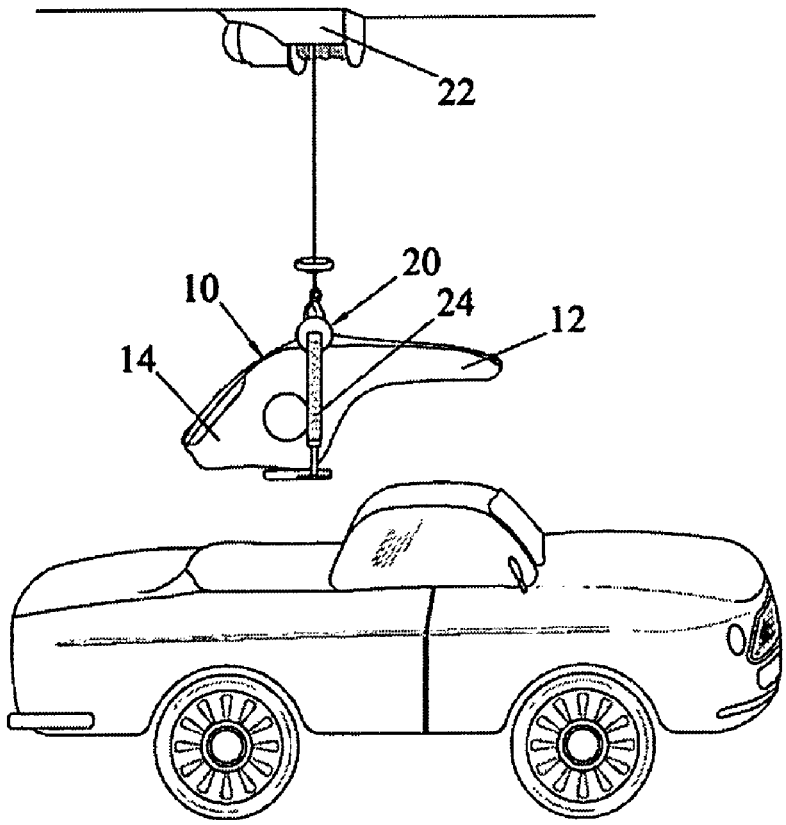

Referring to FIGS. 2 and 4, the sling 20 further comprises a pair of adjustable straps 38, each connected to the intermediate member 28 centrally. The free end of each strap 38 is connected with a detachable engaging hook 40 as seen in FIG. 4. The straps 38 are connected oppositely such that they extend in a direction perpendicular to the pair of arms 26 and the eyebolt 36.

Referring to FIGS. 5 through 8, in order to use the apparatus, initially, the automobile is placed such that the hardtop 10 is located exactly below the winch 22. Then, the rear portion of the hardtop 10 is slightly pulled upwards till the pins are visible; following which, the sling 20 is lowered till the bracket 24 is fitted over the hardtop 10 transversely. More particularly, the bracket 24 is firstly fitted over the front portion of the hardtop 10 and is then slid towards the rear portion of the hardtop 10. The sliding of the bracket 24 over the hardtop 10 is made convenient by a pair of wheels 42 connected to the intermediate member 28 such that the intermediate member 28 passes through the pair of wheels 42 as seen in the referred figures. The wheels 42 are preferably made of a soft material, such as sponge, allowing the pair of arms 26 to be pulled down against the hardtop while engaging the pins. The bracket 24 is to be adjusted back and forth till the pins 18 on the side panels 14 are engaged to the vertical bores 34.

Still referring to FIGS. 4 through 7, once the bracket 24 is locked in position as the pins are engaged, the straps 38 are connected to front and rear extremities of the hardtop 10 without any slack by means of the engaging hooks 40, after which, the sling 20 is gradually elevated by the winch 22. The bracket 24 is covered with a soft fabric, which prevents the hardtop 10 from obtaining scratches and similar undesirables when it comes into contact with the bracket 24. The hardtop 10 can be reinstalled onto the automobile body in the similar fashion.

All features disclosed in this specification, including any accompanying claims, abstract, and drawings, may be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means for" performing a specified function, or "step for" performing a specific function, is not to be interpreted as a "means" or "step" clause as specified in 35 U.S.C. § 112, paragraph 6. In particular, the use of "step of" in the claims herein is not intended to invoke the provisions of 35 U.S.C. § 112, paragraph 6.

Although preferred embodiments of the present invention have been shown and described, various modifications and substitutions may be made thereto without departing from the spirit and scope of the invention. Accordingly, it is to be understood that the present invention has been described by way of illustration and not limitation.

What is claimed is:

1. An apparatus for removing and reinstalling a detachable hardtop of an automobile, wherein the hardtop comprises a pair of opposite side panels, each panel comprising a downwardly extending pin at its bottom, the apparatus comprising;

(a) a first means for engaging the pins adapted to fit over the hardtop transversely, the first means comprising two ends, each end in turn comprising a hole for receiving the pin;

(b) a second means for elevating and lowering the hardtop about the first means; and (c) a third means for balancing the hardtop whereby the hardtop is maintained in the same horizontal position as on the automobile when elevated and/or lowered.

2. The apparatus of claim 1, wherein the first means comprises a bracket comprising a pair of arms extending from the extremities of an intermediate member; the ends of each arm comprising the hole for receiving the pin.

3. The apparatus of claim 2, wherein the bracket is of an inverted 'U' shape.

4. The apparatus of claim 2, wherein the bracket is made of metal.

5. The apparatus of claim 2, wherein the bracket is a unitary piece.

6. The apparatus of claim 2, wherein the arms extend parallel to each other.

7. The apparatus of claim 6, wherein each arm is substantially perpendicular to the intermediate member.

8. The apparatus of claim 2, wherein the intermediate member and the arms are of same cross-section.

9. The apparatus of claim 8, wherein the intermediate member and the arms are of uniform circular cross-section.

10. The apparatus of claim 2, wherein the bracket is covered with a soft fabric so as to prevent the hardtop from obtaining scratches when it comes into contact with the bracket.

11. The apparatus of claim 2, wherein the intermediate member includes a means for moving the bracket to and fro over hardtop so as to aid the arms in engaging the pins.

12. The apparatus of claim 11, wherein the means for moving the bracket to and fro comprises at least two spaced-apart wheels; the intermediate member passing through the at least two wheels.

13. The apparatus of claim 12, wherein the at least two wheels are made of a soft sponge-like material, allowing the bracket to be pulled down against the hardtop while engaging the pins.

14. The apparatus of claim 12, wherein the at least two spaced-apart wheels comprises two spaced-apart wheels.

15. The apparatus of claim 2, wherein the intermediate member is fitted with an eyebolt centrally such that the eyebolt extends in the direction opposite to that of the, arms; the bracket is to be elevated about the eyebolt by the second means comprising an overhead winch.

16. The apparatus of claim 15, wherein the winch is electrically operated.

17. The apparatus of claim 15, wherein the automobile is to be placed such that the hardtop is located directly below the overhead winch.

18. The apparatus of claim 2, wherein the intermediate member is connected with at least two adjustable straps, the at least two straps to extend in opposite directions while being perpendicular to the intermediate member and the pair of arms, the free end of each strap comprises an engaging hook; the hooks are adapted to engage the front and rear extremities of the hardtop so that when the hardtop is elevated about the bracket, the straps balance the hardtop in the same position as on the automobile top; the at least two straps making up the third means.

19. The apparatus of claim 18, wherein each of the at least two straps are connected to intermediate member centrally.

20. The apparatus of claim 18, wherein the at least two adjustable straps comprises two adjustable straps.

* * * * *